US006905066B2

(12) United States Patent
Holley, Jr. et al.

(10) Patent No.: US 6,905,066 B2
(45) Date of Patent: Jun. 14, 2005

(54) CARTON HAVING A STRAP HANDLE

(75) Inventors: John M. Holley, Jr., Lawrenceville, GA (US); James R. Oliff, Douglasville, GA (US)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/280,405

(22) Filed: Oct. 25, 2002

(65) Prior Publication Data

US 2003/0080180 A1 May 1, 2003

Related U.S. Application Data

(60) Provisional application No. 60/347,968, filed on Oct. 27, 2001, and provisional application No. 60/332,455, filed on Nov. 17, 2001.

(51) Int. Cl.[7] ..... B65D 5/46

(52) U.S. Cl. ..... 229/117.13; 229/117.14; 229/122

(58) Field of Search ..... 229/122.1, 122, 229/143, 117.13, 117.14

(56) References Cited

U.S. PATENT DOCUMENTS

| | | | | |
|---|---|---|---|---|
| RE25,949 E | | 12/1965 | Andre | |
| 3,904,036 A | | 9/1975 | Forrer | |
| 4,588,084 A | * | 5/1986 | Holley, Jr. | 206/427 |
| 5,595,292 A | | 1/1997 | Bates | |
| 5,639,017 A | * | 6/1997 | Fogle | 229/117.14 |
| 5,738,273 A | * | 4/1998 | Auclair | 229/117.13 |
| 6,019,276 A | * | 2/2000 | Auclair | 229/103.2 |
| 6,065,590 A | * | 5/2000 | Spivey | 206/141 |
| 6,129,266 A | * | 10/2000 | Oliff et al. | 229/117.13 |

FOREIGN PATENT DOCUMENTS

| | | |
|---|---|---|
| CA | 1 243 987 | 11/1988 |
| EP | 0 203 806 A2 | 5/1986 |
| WO | 96/27538 A1 | 9/1996 |

* cited by examiner

*Primary Examiner*—Tri M. Mai
(74) *Attorney, Agent, or Firm*—Tsugihiko Suzuki

(57) ABSTRACT

A carton includes a top panel, a pair of opposed end panels, and an integral strap handle that has a medial grip portion, a pair of wider portions and opposed end portions. The opposed end portions are formed from the end panels while the medial and wider portions are formed from the top panel. The strap handle is movable from a stowed position where the medial and wider portions lie in the plane of the top panel to a use position where the medial portion is arched upwardly from the plane of the top panel. The strap handle defines in the top panel an opening extending across the top panel. A relief notch is formed in the top panel at a location directly adjoining each wider portion along a complementary side edge of the opening.

23 Claims, 15 Drawing Sheets

X 12A
232A
67A
80A
226A
24A
65A
230A
78A
82A
36A
81A
18A
32A
X

CARTON HAVING A STRAP HANDLE

This application claims the benefit of Provisional Applications Nos. 60/347,968 and 60/332,455, filed Oct. 27, 2001 and Nov. 17, 2001, respectively.

BACKGROUND OF THE INVENTION

This invention relates generally to cartons having strap handles integrally formed with the cartons, and more particularly to a carton with an integral strap handle formed from a carton wall and having a relatively narrow medial grip portion and a pair of wider portions joined to the opposite ends of the medial grip portion. The invention also relates to an arrangement for reinforcing a strap handle of a carton and further to an arrangement for facilitating inward movement of the opposite end portions of a strap handle when the carton is lifted by the strap handle.

Cartons having integral strap handles are well known in the art. An example of the strap handle carton is disclosed in Canadian Patent No. 1,243,987 in which a carton is illustrated as having a strap handle that is formed primarily from a top wall. The strap handle includes a longitudinally elongated medial grip portion and a pair of wider portions located at opposite ends of the medial grip portion. Each wider portion is defined by a pair of cut lines that diverge from the medial grip portion toward the adjacent end edge of the top wall. To lift the carton, the strap handle is gripped at the medial grip portion and pulled upward, which displaces the handle from a stowed position where the handle lies in the plane of the top wall to a use position where it is arched upwardly from the plane of the top wall. During this displacement, the wider portions of the handle are inwardly moved toward each other while the respective parts of the wider portions near the end edges of the top wall are moved downwardly under the plane of the top wall. Such movements cause the wider portions to be wedged into narrower portions of an opening in the top wall defined by the handle itself. In the wedged condition, the opposite side edges of each wider portion are disposed transversely of the complementary edges of the opening and scraped against the complementary edges. This often results in tear in either or both of the handle strap and the top wall. This problem is even aggravated when the carton is actually carried by the handle.

U.S. Pat. No. 5,738,273 discloses another example of the strap handle carton wherein the top wall comprises a pair of inner and outer panels and the strap handle is formed in part from the inner top panel and in part from opposed inner end flaps that are hingedly connected the end edges of the inner top panel. The inner end flaps are glued to opposed outer end flaps that are hingedly connected to the end edges of the outer top panel. For this purpose, glue is applied typically along the lower edges of the end flaps such that the opposed end portions of the strap handle yet are free of restraint of the outer end flaps. This specific glue location is required in order to allow inward movement of the opposed end portions of the strap handle when the carton is lifted by the handle. If glued to the outer end flaps, the handle end portions would be forcibly peeled from the outer end flaps, which could damage the fibrous structure of the handle ends. Although the glue locations are almost precisely controllable by the use of modern packaging machines, having precautionary measures would always be warranted to prevent undesired rupture of the strap handle.

What is needed, therefore, is a carton having an integral, wide-ended strap handle wherein the interference of the strap handle with the top wall is effectively prevented or at least mitigated during the use of the strap handle. Such a carton should be provided with means for preventing the wider portions from being caught by complementary edges of the opening in the top wall. A carton having handle-reinforcing means that would compensate for a potential peeling damage of the strap handle is also needed. What is further needed is an arrangement wherein inward movement of the handle end portions is facilitated upon lifting of the carton by the strap handle. Such an arrangement should be provided particularly when the handle end portions are reinforced.

SUMMARY OF THE INVENTION

The present invention provides a carton including a first top panel, a pair of opposed end panels hingedly connected to the top panel, and an integral strap handle extending between the end panels across the top panel. The strap handle include a medial grip portion, a pair of wider portions joined to the opposite ends of the medial grip portion and opposed end portions connected to the wider portions respectively. The opposed end portions are formed from the end panels while the medial and wider portions are formed from the top panel. The strap handle is movable from a stowed position where the medial and wider portions lie in the plane of the top panel to a use position where the medial portion is arched upwardly from the plane of the top panel. The strap handle defines in the top panel an opening or cutout extending across the top panel. Means for defining a relief notch in the top panel is provided at the location directly adjoins each wider portion along a complementary side edge of the opening so that a part of the respective wider portion is extended through the relief notch when the strap handle is moved to the use position. This arrangement prevents the wider portions from being scraped against the complementary side edge of the opening.

In a preferred embodiment of the invention, the relief notch is defined by a hinged tab. Such tab may be defined by a slit in the top panel and by a fold line hingedly connecting the hinged tab to the top panel.

In another preferred embodiment of the invention, the relief notch is defined by a plurality of hinged tabs. The hinged tabs may be cut from the top panel by one or more slits such that when the strap handle is moved to the use position, the part of each wider portion moves into one of the slits to thrust one or more of the hinged tabs upward and the other tabs downward. The one or more slits for the relief notch may emanate from a fold line by which the hinged tabs are connected to the top panel and extend to the complementary side edge of the opening defined by the strap handle.

In a further preferred embodiment, the carton further includes a second top panel secured to the outside surface of the first top panel to form a composite top wall. The second top panel may have a handle access opening aligned in part with the medial grip portion of the strap handle and in part with the wider portions of the strap handle. The width of the access opening at its opposite extreme ends may be greater than the width of the wider portions at the positions aligned with the opposite extreme ends.

According to another aspect of the invention, a carton includes top and base panels interconnected by opposed side panels to form a tubular structure, opposed end closure structures for at least partially closing the opposite ends of the tubular structure, and an integral strap handle extending between the end closure structures across the top panel. Each end closure structure includes a pair of side end flaps hingedly connected to the side panels and a top end flap hingedly connected to the top panel and disposed on the outside surfaces of the adjacent side end flaps. The strap handle includes a medial grip portion formed from the top panel and opposed end portions formed respectively from the opposed top end flaps. The strap handle is movable from a stowed position where the end portions lie in the respective planes of the top end flaps to a use position where the end portions are disposed inwardly of the respective planes of the top end flaps. At least one yielding flap is formed from the side end flaps of each end closure structure and disposed along the adjacent end portion of the strap handle so as to be displaceable inwardly of the carton. These yielding flaps are inwardly displaced in response to inward movement of the handle end portions to the use position and thereby facilitate inward movement of the handle end portions.

In a preferred embodiment of this aspect of the invention, the yielding flaps are secured to the end portions of the strap handle respectively to reinforce the strap handle.

In another preferred embodiment, each yielding flap is defined by a severance line in the respective side end flap and by the free end edge of the respective side end flap. The severance line may extend downwardly from the upper edge of the respective side end flap. The severance lines may be disposed and located such that the severance line of the respective side end flap is generally registered with the adjacent side edge of the adjacent end portion of the strap handle.

In a still another preferred embodiment, the size of the side end flaps is such that the side end flaps of each end closure structure overlap each other and as a whole extend entirely across the width of the carton. Each side end flap of each end closure structure may be provided at its upper end corner with a beveled edge. The beveled edges of the mating side end flaps may define a notch for receiving an article packaged in the carton.

According to a further aspect of the invention, a carton includes a pair of inner and outer top panels secured together in an overlapping relationship to form a composite top wall, a pair of opposed end flaps hingedly connected to the inner top panel, an integral strap handle extending between the end flaps across the inner top panel, and a handle-reinforcing strip disposed in face-contacting relationship with the strap handle. The strap handle includes a medial grip portion, a pair of wider portions joined to the opposite ends of the medial grip portion, and a pair of opposed end portions connected to the wider portions respectively. The opposed end portions of the strap handle are formed from the end flaps respectively while the medial and wider portions are formed from the inner top panel. The reinforcing strip is disposed entirely along the strap handle and is hingedly connected to the end flaps along first and second fold lines that are inset from the adjacent side edges of the end portions of the strap handle.

In a preferred embodiment of this aspect of the invention, the reinforcing strip is hingedly connected to the medial grip portion of the strap handle along a third fold line that is aligned with the first and second fold lines.

In another preferred embodiment, the end portions of the strap handle are formed with article-receiving openings respectively. The reinforcing strip may be formed with windows disposed in registry with the openings respectively. Each opening of the strap handle may be defined by a pair of yieldable tabs formed from the respective end portion of the strap handle. The yieldable tabs of each opening may be hingedly connected to the respective end portion.

DETAILED DESCRIPTION OF THE PREFERRED EMBODIMENTS

Figure 1:
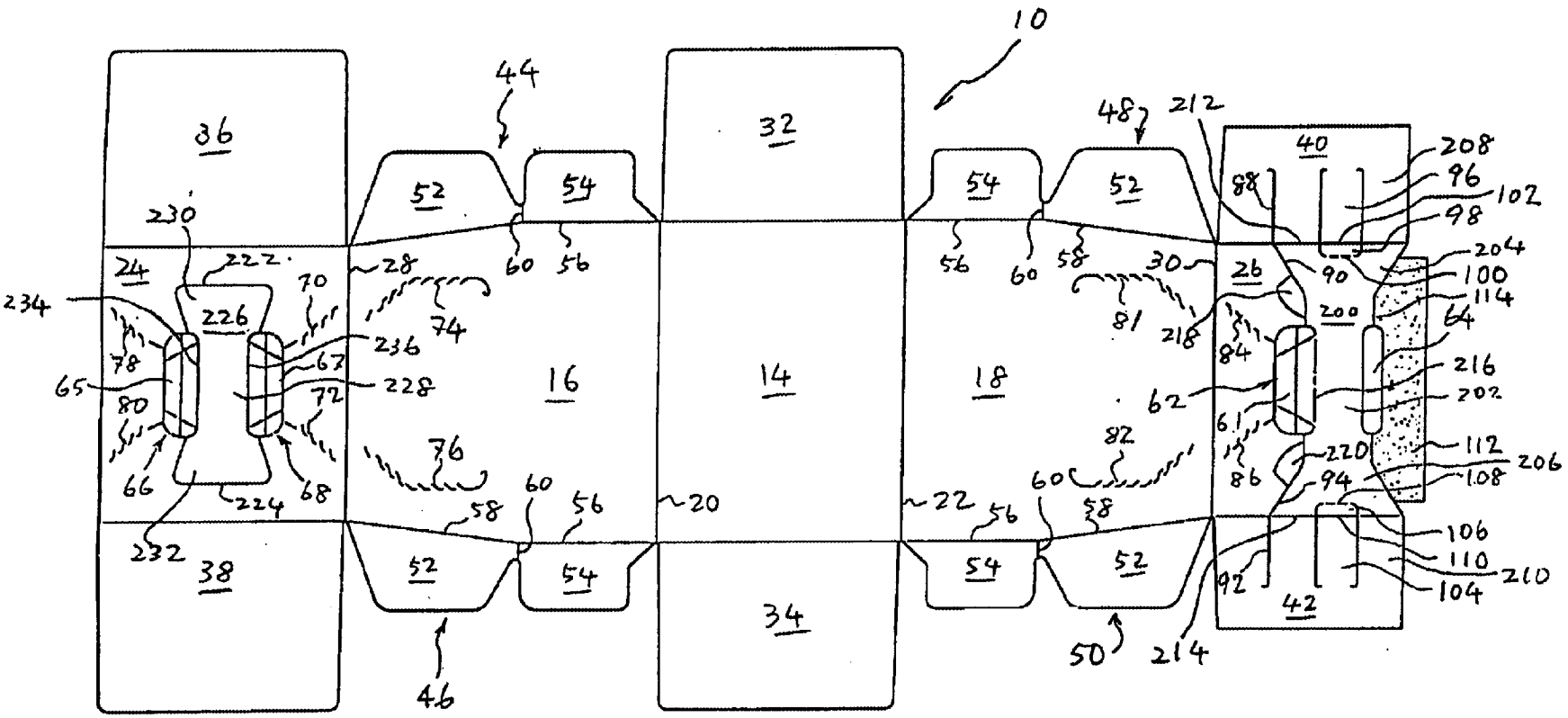
FIG. 1 shows a plan view of a blank as viewed from its inner surface, from which a carton according to this invention is formed.
Figure 5:
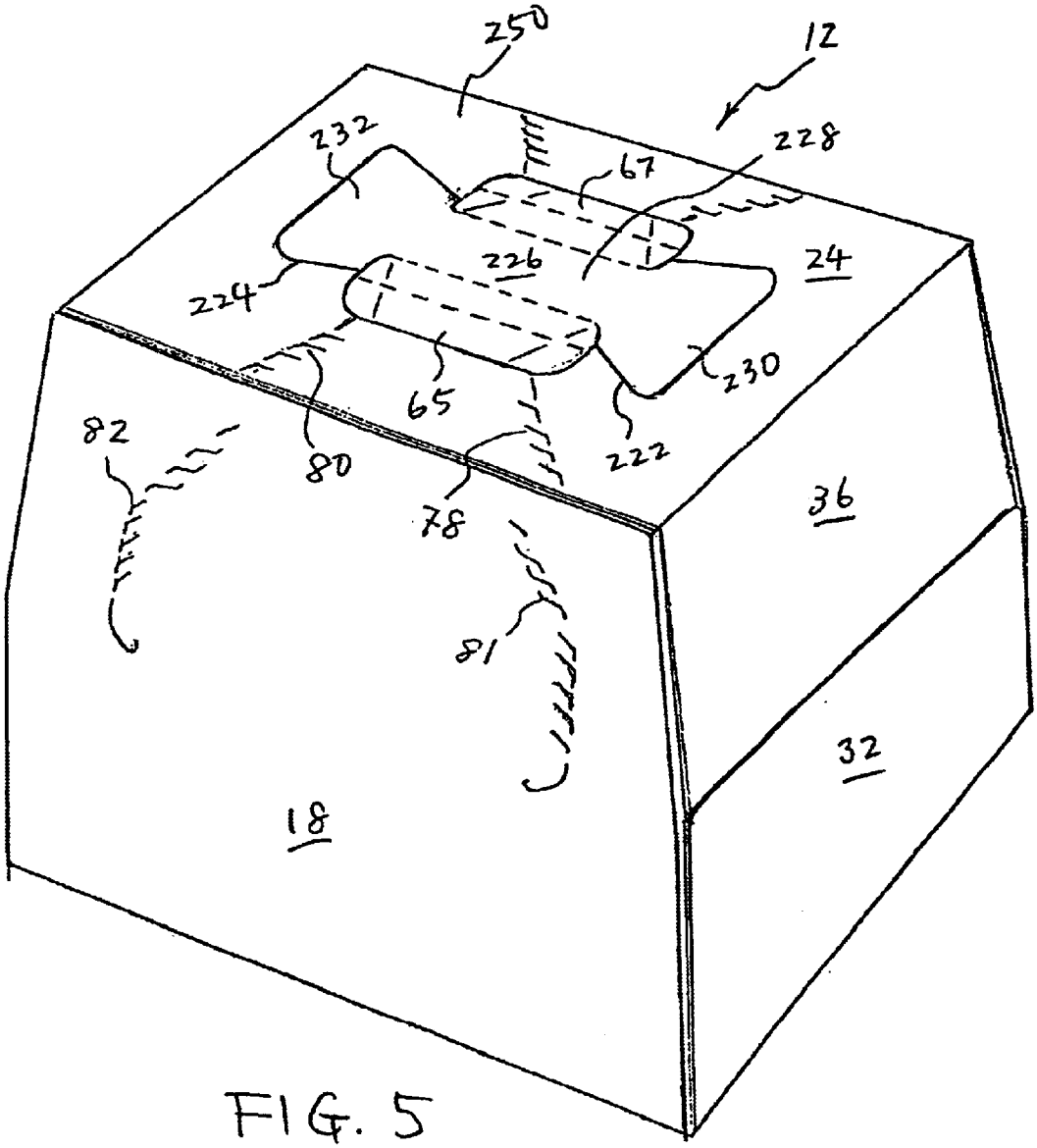
FIG. 5 is a perspective view of a completed carton erected from the blank of FIG. 1.

In FIG. 1, there is shown a blank 10 which when constructed, forms a carton 12 in FIG. 5 for a plurality of bottles. In this embodiment, the carton 12 is a fully enclosed carton designed to accommodate twelve bottles arranged in three rows each containing four bottles, but the blank or carton may be modified for any number of bottles, cans or other articles.

The blank 10 has a base panel 14, a pair of side panels 16 and 18 hingedly connected thereto along fold lines 20 and 22 respectively, and first and second top panels 26 and 24 hingedly connected to the side panels 18 and 16 along fold lines 30 and 28 respectively. The fold lines 20, 22, 28 and 30 may be simple score lines, partially cut score lines, perforated lines or other suitable means. The base panel 14 has lower end flaps 32 and 34 which in use are folded up, and the top panels 24 and 26 have upper end flaps 36, 38, 40 and 42 which in use are folded down. Hingedly connected to the side panels 16 and 18 are side end flaps 44, 46, 48 and 50 which are folded inwardly and are adhesively secured to the inside surfaces of the end flaps 32, 34, 36 and 38 so as to fully enclose the ends of the carton 12. The side end flaps 44, 46, 48 and 50 each includes upper and lower portions 52 and 54. The lower portion 54 of each side end flap is hingedly connected to the respective side panel along a vertical fold line 56 while the upper portion 52 of each side end flap is hingedly connected to the respective side panel along an inwardly inclined fold line 58. The upper and lower portions 52 and 54 of each side end flap are interconnected by a short fold line 60.

The first and second top panels 26 and 24 in this embodiment are adapted to be secured together in overlapping relationship to form a composite top wall 250 (FIG. 5) of the carton 12. The second top panel 24 forms an outer layer of the top wall while the first panel 26 forms an inner layer. Finger receiving apertures and an associated flap 61 of conventional construction are formed in the first or inner top panel 26. The finger receiving aperture having the flap 61 is designated generally by the reference numeral 62 while the associated aperture with no flap is designated by reference numeral 64. Similar finger receiving apertures and their associated flaps 65 and 67 are formed in the second or outer top panel 24 and are designated generally by the reference numerals 66 and 68. A tear flap for creating an access opening is defined by tear lines 70 and 72 formed in the outer top panel 24 together with tear lines 74 and 76 in the side panel 16. Another pair of tear lines 78 and 80 are formed in the outer top panel 24. These tear lines 78 and 80 define another tear flap together with pairs of tear lines 81 and 82; and 84 and 86 in the side panel 18 and the inner top panel 26, respectively.

The inner top panel 26 incorporates a series of tear lines 88, 90, 92 and 94 which define a strap handle 200 with the free side edge. More specifically, the tear line 88 is formed in the upper end flap 40 and connects with the tear line 90 formed in inner top panel 26 that extends to the finger receiving aperture 62. Similarly the tear line 92 is formed in the upper end flap 42 and connects with the tear line 94 formed in the inner panel 26 that extends to the aperture 62. The strap handle 200 is thus defined by the tear lines 88, 90, 92 and 94 in cooperation with the finger-receiving aperture 62. The strap handle 200 includes a relatively narrow medial grip portion 202, opposed wider portions 204 and 206 joined to the ends of the medial portion 200, and opposed forked end portions 208 and 210 hingedly connected to the wider portions 204 and 206 along fold lines 212 and 214 respectively. Each wider portion has a pair of oblique side edges diverging from the medial portion 202 to the adjacent forked end portion. The medial portion 202 and the wider portions 204 and 206 are formed from the inner top panel 26 while the forked end portions 208 and 210 are formed from the upper end flaps 40 and 42 respectively. Upon formation of the top wall, the inner top panel 26 is folded across the top of the carton and the outer top panel 24 is folded over and is adhesively secured to the inner top panel 26. The tear lines 88, 90, 92 and 94 and the finger aperture 62 are located such that the strap handle 200 is located generally centrally between the two side panels 16 and 18.

The aforementioned flap 61 of the finger-receiving aperture 62 is hingedly connected to the medial grip portion 202 along a fold line 216. An yieldable tab 96 is struck from the forked end portion 208 and foldably joined to the upper end flap 40 while a short stub tab 98 is struck from the wider portion 204 and is hingedly connected thereto along fold line 100. The adjacent ends of the tabs 96 and 98 are initially interconnected by severable means such as half cut 102 that is aligned with the fold line 212. At the opposed end of the strap handle 200, an yieldable tab 104 is struck from the forked end portion 210 and foldably joined to the upper end flap 42 while a short stub tab 106 is struck from the wider portion 206 and hingedly connected thereto along fold line 108. The adjacent ends of the tabs 104 and 106 are initially interconnected by severable half cut 110 that is aligned with the fold line 214.

A relief notch 218 is defined in the inner top panel 26 at a location along the tear line 90, thereby interrupting the tear line 90. The location of the relief notch 218 is such that the wider portion 204 is directly flanked or adjoined at its oblique side edge along the tear line 90 by the relief notch 218. In like manner, a relief notch 220 is defined in the inner top panel 26 at a location along the tear line 94, thereby interrupting the tear line 94. As a result, the wider portion 206 is directly adjoined at its oblique side edge along the tear line 94 by the relief notch 220. The function of these relief notches 218 and 220 is described later.

A handle-reinforcing panel 112 is foldably joined to the medial grip portion 202 of the strap handle 200 along an interrupted fold line 114.

The outer top panel 24 is further provided with a pair of C- or U-shaped tear lines 222 and 224. The tear line 222 emanates from an end of the finger apertures 66 and terminates at the adjacent end of the finger aperture 68 while the tear line 224 emanates from the other end of the aperture 66 and terminates at the other end of the aperture 68. These tear lines 222 and 224 are opposed to each other while curving concavely toward each other. As a result, a dust panel or cover strip 226 is defined at the central area of the outer top panel 24 surrounded by the tear lines 222 and 224 and the finger apertures 66 and 68. The cover strip 226, upon formation of the top wall, is located above the strap handle 200. The middle portion 228 of the cover strip 226 disposed between the finger apertures 66 and 68 is to be vertically aligned with the medial grip portion 202 of the strap handle 200 while the opposed larger end portions 230 and 232 of the cover strip 226 are to be disposed on the wider portions 204 and 206 of the strap handle 200 respectively. The respective flaps 65 and 67 of the finger apertures 66 and 68 are hingedly connected to the middle portion 228 by fold lines 234 and 236.

Turning to the construction of the carton 12 illustrated in FIG. 5, the blank 10 requires a series of sequential folding and securing operations which can be performed in a straight line machine so that the carton is not required to be rotated or inverted to complete its construction. The folding process is not limited to that described below and can be altered according to particular manufacturing requirements.

Figure 2:
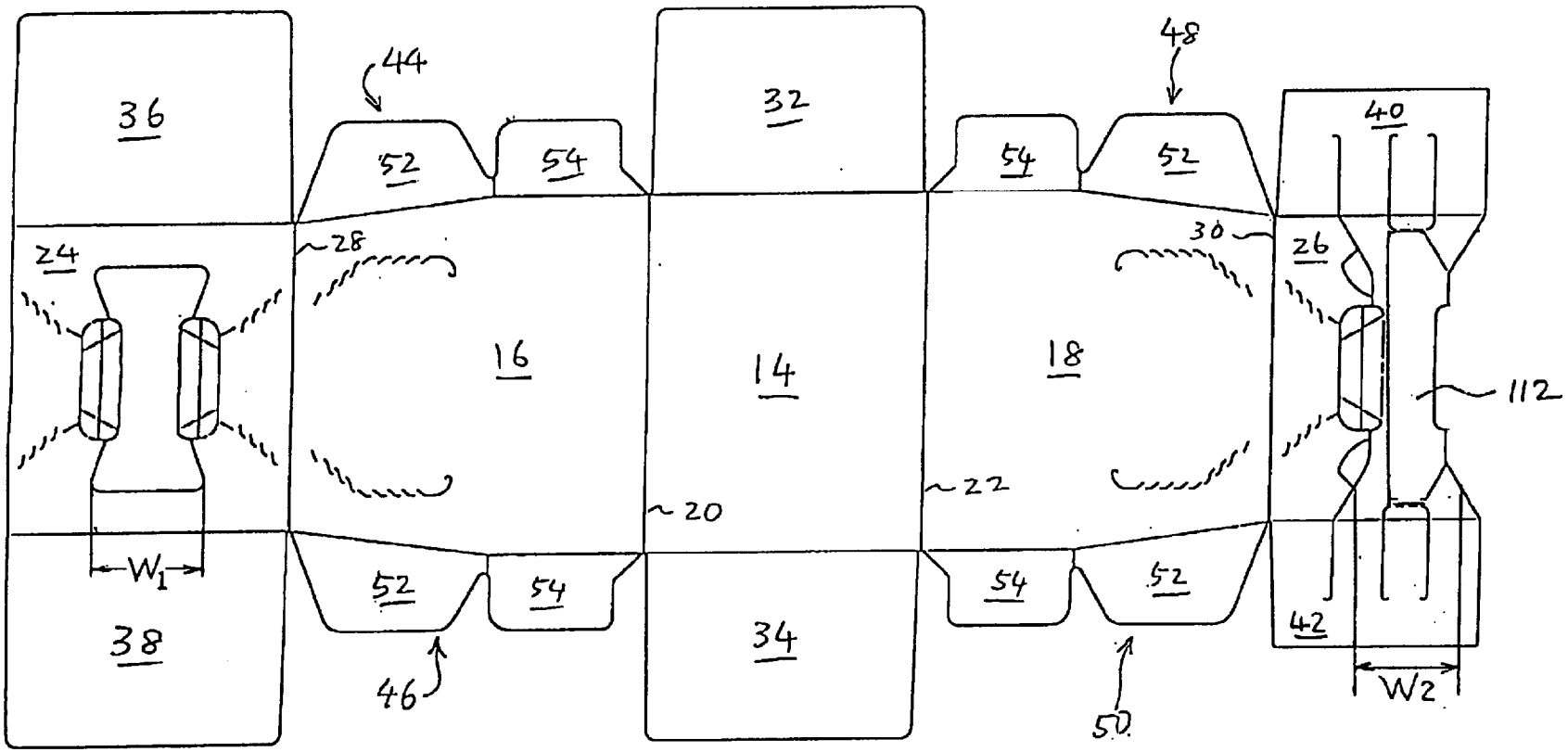
FIGS. 2–4 are series of plan views showing the manner in which the blank of FIG. 1 may be folded to form a completed collapsed carton.
Figure 3:
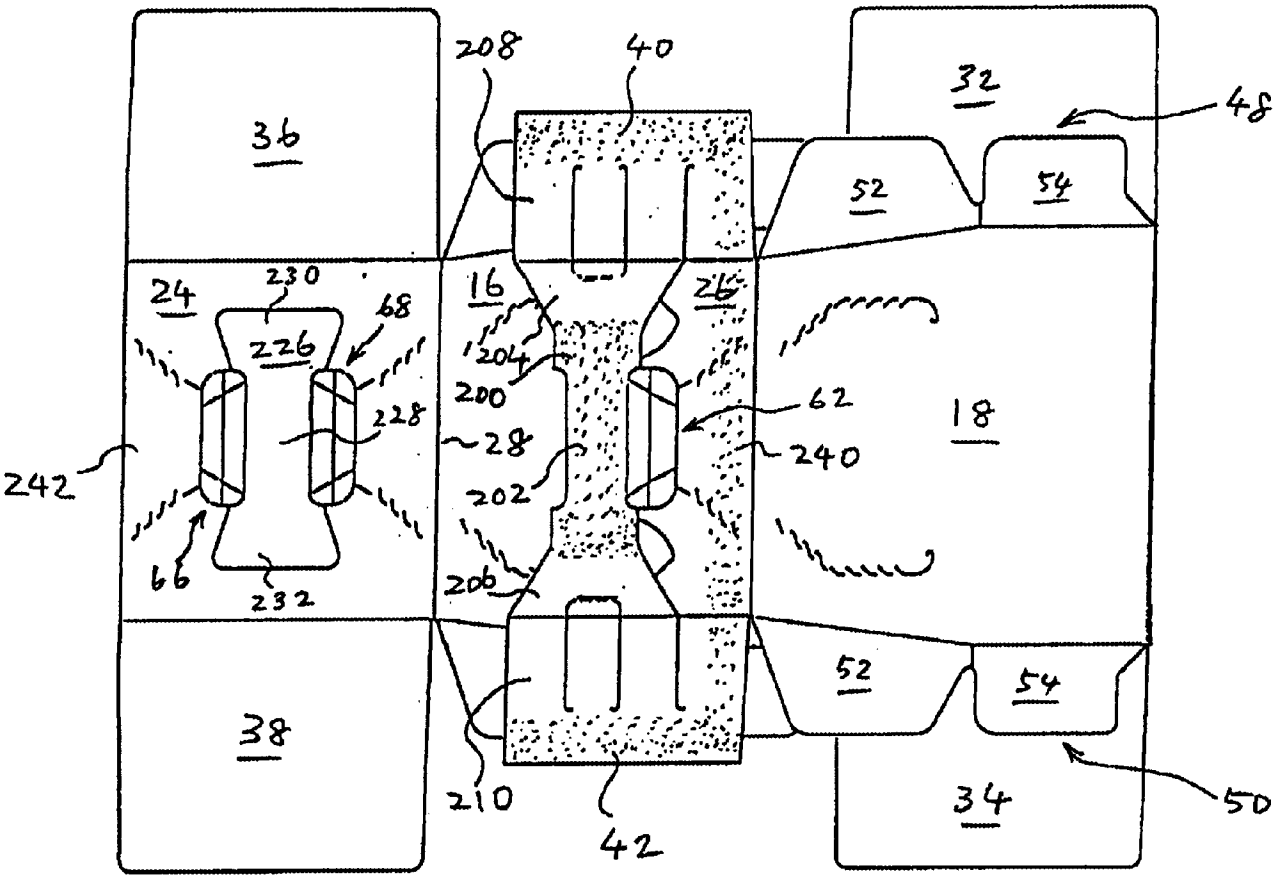
Figure 4:
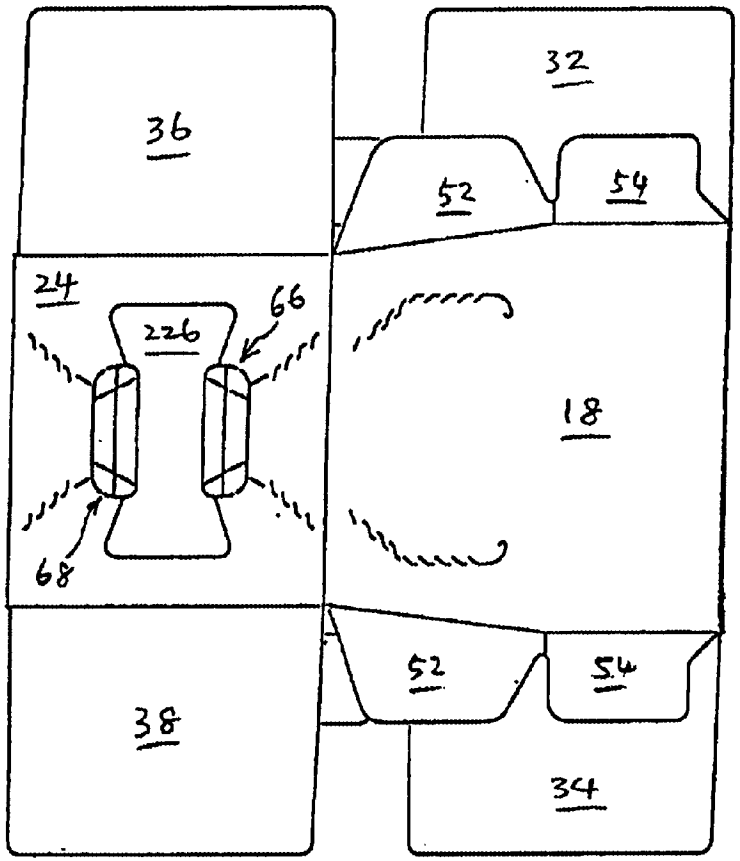

Initially an application of glue is made to the inner surface of reinforcing panel 112 as indicated by the stippling in FIG. 1. The reinforcing panel 112 is then folded upwardly and to the left along the interrupted fold line 114 so as to occupy the position shown in FIG. 2. The side panel 18 together with the inner top panel 26 and the folded reinforcing panel 112 as viewed in FIG. 2 are then elevated and folded to the left along fold line 22 together with their end flaps 48, 50, 40 and 42. An application of glue is then made to the outside surface of the inner top panel 26 and to the upper end flaps 40 and 42 as shown by the stippling in FIG. 3 wherein the forked end portions 208 and 210 of the strap handle 200 are shown as being free of glue. Thereafter, the outer top panel 24 and its associated upper end flaps 36 and 38 as viewed in FIG. 3 are elevated and folded toward the right along the fold line 28. This operation causes the stippled glue area 240 on the inner top panel 26 to become adhered to the inside surface of the free side edge area 242 of the outer top panel 24. Simultaneously, the stippled area on the end flap 40 becomes adhered to the inside surface of the upper end flap 36 while the stippled area on the end flap 42 becomes adhered to the inside surface of the upper end flap 38. Further, the stippled area of the strap handle becomes adhered to the inside surface of the cover strip 226. The collapsed tubular carton then appears as shown in FIG. 4.

With the carton formed as described above by the carrier manufacturer, it is then shipped to the bottler who sets the carton up into an erected tubular form (not shown) and loads filled bottles through the open ends of the tubular carton. Thereafter the end flaps are folded inwardly in the sequence of the side end flaps, the composite upper end flaps, and the lower end flaps and the carton when fully loaded and completed by the bottler appears as shown in FIG. 5 with the upper edge of each lower end flap secured in overlapping glued contact with the lower edge of the associated upper end flap.

Figure 6:
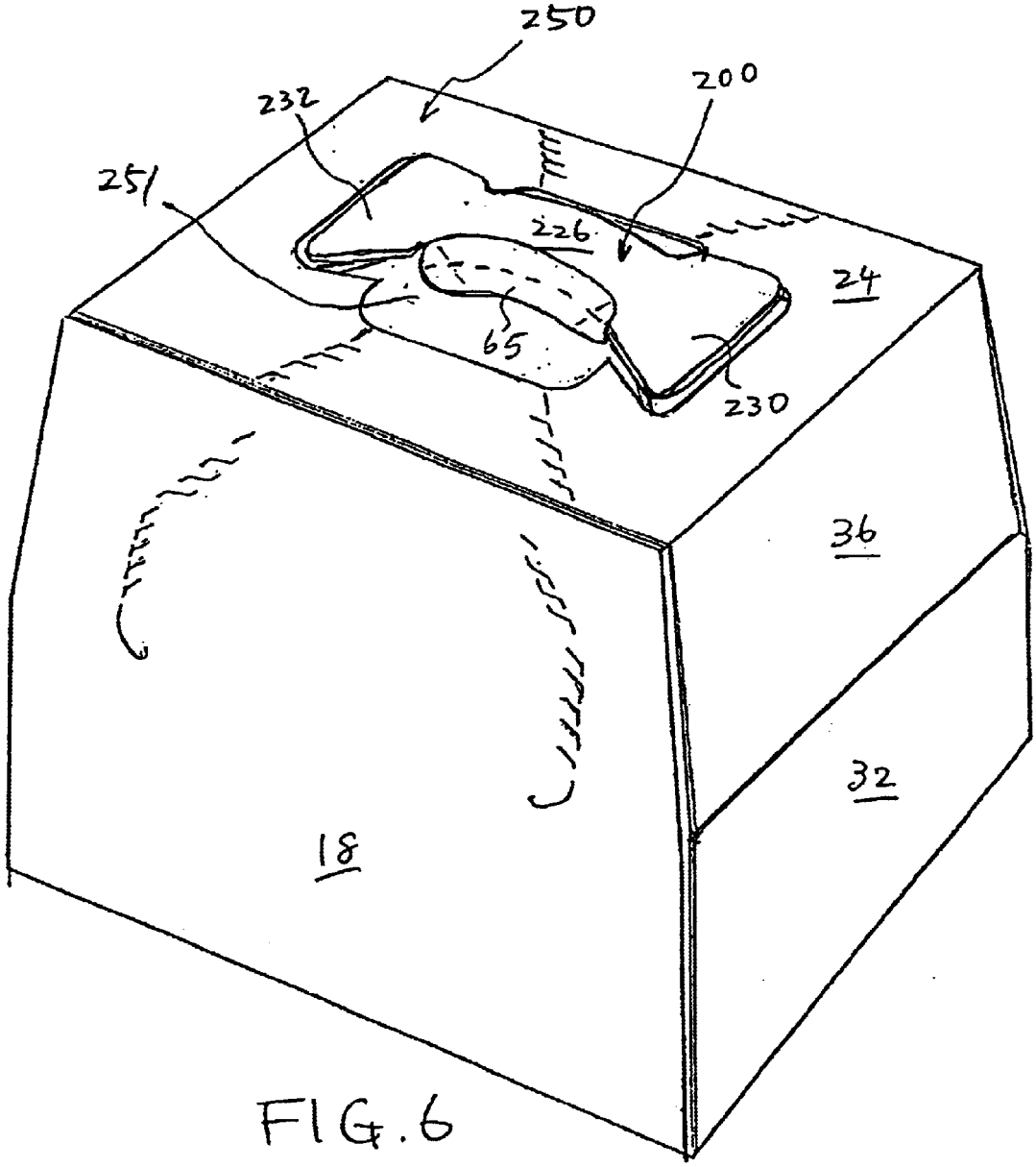
FIG. 6 is a perspective view of the carton of FIG. 5, showing the handle lifted upwardly.
Figure 7:
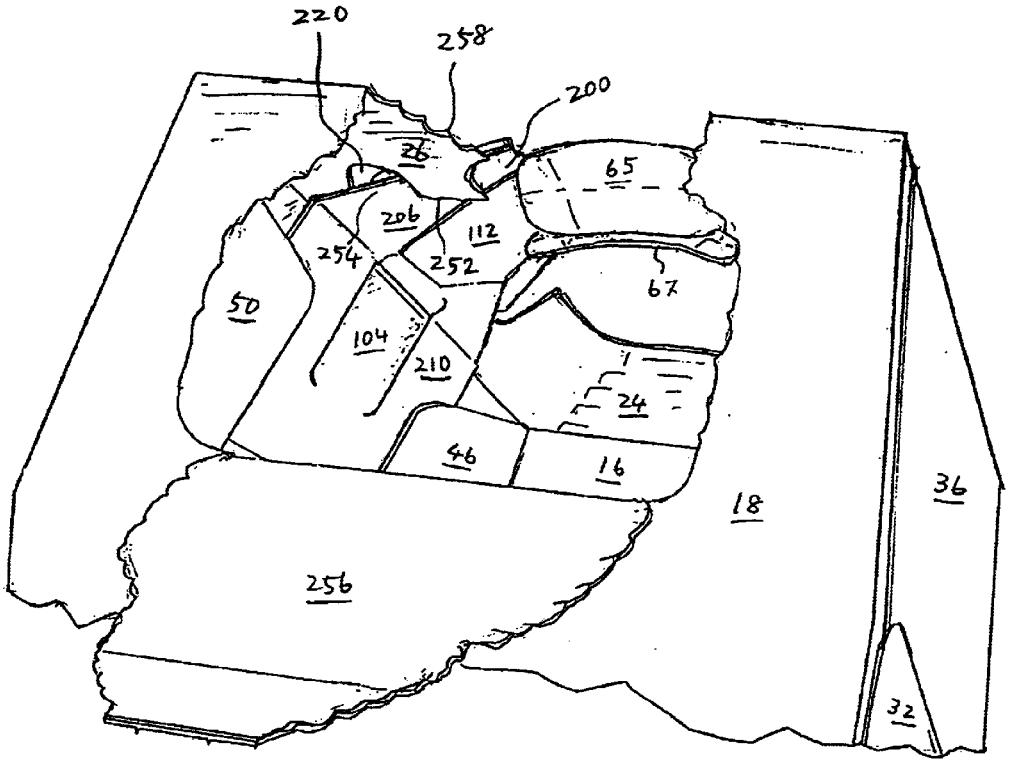
FIG. 7 is a fragmentary perspective view of the carton of FIG. 5, in which the tear flap is broke open to show the inside of the carton.

The consumer transports the completed carton package from its point of purchase. To carry the carton 12, the strap handle 200 can be used. To use the handle 200, the flaps 65 and 67 and the flap 61 underlying the flap 65 are pushed inwardly of the carton and folded downwardly about their respective fold lines 234, 236 and 216. The fingers of the user can then be inserted into the finger apertures 66 and 68 and the underlying aperture 62 and grasp the medial portion 202 of the strap handle 200 together with the middle portion 228 of the cover strip 226. Lifting the carton 12 by the strap handle 200 causes the cover strip 226 to be severed from the outer top panel 24 along the C-shaped tear lines 222 and 224 as well as the strap handle 200 to be severed from the inner top panel 26 and the end flaps 40 and 42 along the tear lines 88, 90, 92 and 94. This, in turn, causes the strap handle 200 to arc out of the general plane of the top wall through the opening 251 defined by the cover strip 226. This is best shown in FIG. 6 where the strap handle 200 that is mostly hidden from view by the cover strip 226 and the top panel 24 is pulled out of the carton through the opening 251 and taking an arched use position. When the handle 200 is moved from its stowed position in FIG. 5 into the use position of FIG. 6, the wider portions 204 and 206 of the strap handle 200 are pulled toward each other together with the adjacent forked end portions 208 and 210 so that a slack is available for the handle 200 to take the use position. Simultaneously, the respective areas of the wider portions 204 and 206 near the fold lines 212 and 214 are pulled downwardly under the plane of the top wall 250. Such movements cause the respective oblique side edges of the wider portions 204 and 206 defined by the tear lines 90 and 94 to be received in, and extended through, the relief notches 218 and 220 respectively. This is best shown in FIG. 7 wherein the oblique side edge 254 of the wider portion 206 is received in the relief notch 220 and extended through the notch 220. By this means, abutting and scraping of the oblique side edge of each wider portion against the complementary edge of the opening (or cutout) 252 in the inner top panel 26 is prevented, which would otherwise be caused without the relief notches 218 and 220. In addition, the width of the larger end portions 230 and 232 at their extreme ends may be arranged to be greater than the width at the registered positions of the wider portions 204 and 206. Such an arrangement prevents abutting and scraping of the wider portions 204 and 206 against the complementary side edges of the opening 251 in the outer top panel 24.

During the above operation, the yielding tabs 96 and 104 remain flat with the respective end flaps 40 and 42 so that the openings defined by the yielding tabs 96 and 104 receives the end bottles of the center row of the packaged bottle group to allow the forked end portions 208 and 210 to move toward each other.

In order to open the carrier, the user's fingers are simply inserted, for example, into the finger aperture 66 and an upward force is then applied. Such upward force severs the tear flap section 256 (FIG. 7) defined by tear lines 78, 80, 81 and 82 from the carton walls and define an access opening 258 (FIG. 7) that extends from the top wall 250 into the side panel 18. The user's fingers may also be inserted into the finger aperture 68 to sever the tear flap section defined by tear lines 70, 72, 74 and 76 from the carton walls.

After the contents of the bottles have been consumed, the bottles may be replaced into the carton as shown in FIG. 7 for easy return to the point of purchase.

Figure 8:
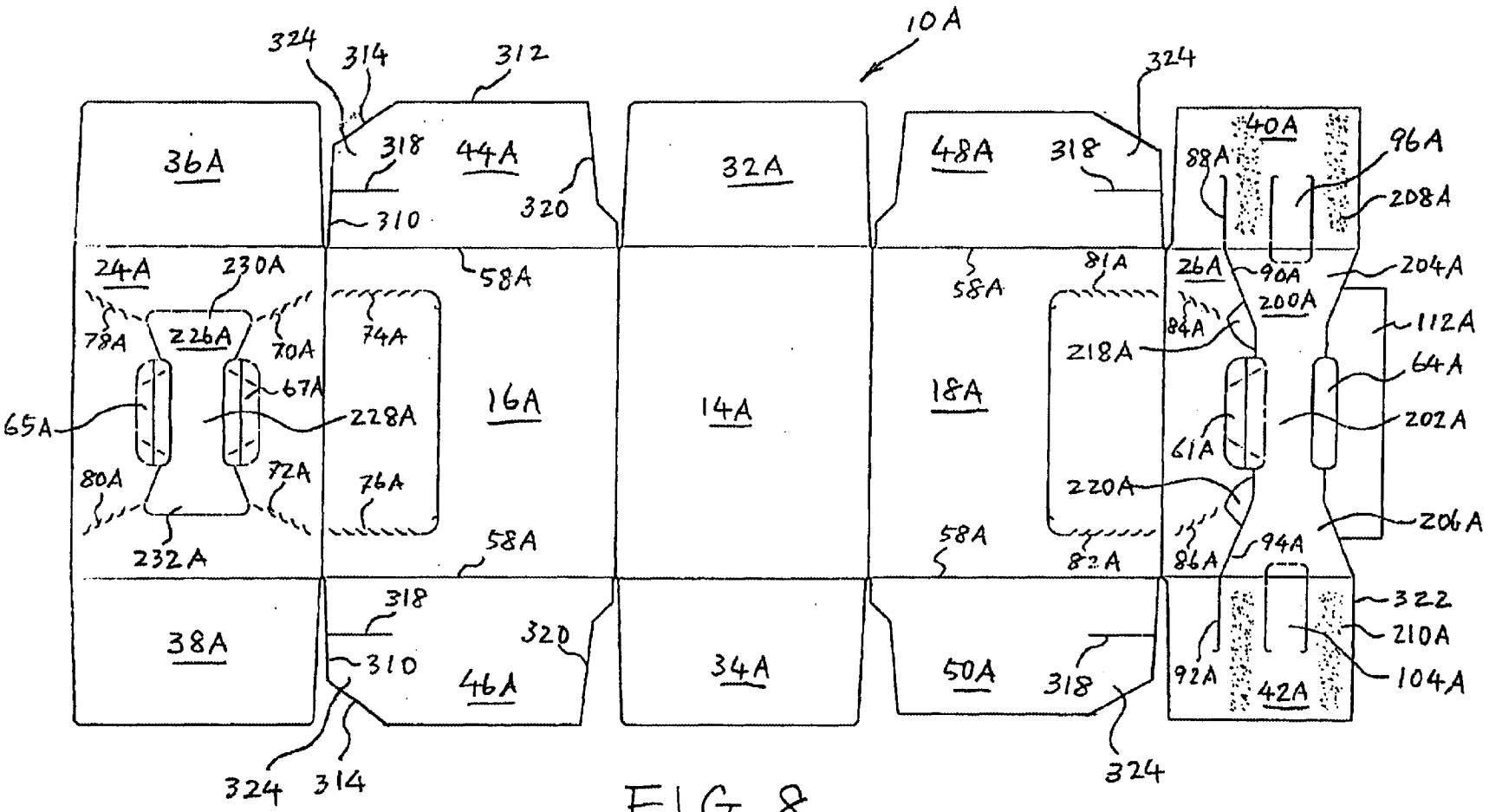
FIG. 8 is a plan view of the second embodiment of the present invention, showing a blank as viewed from its inner surface, from which a carton of the second embodiment is formed.
Figure 9:
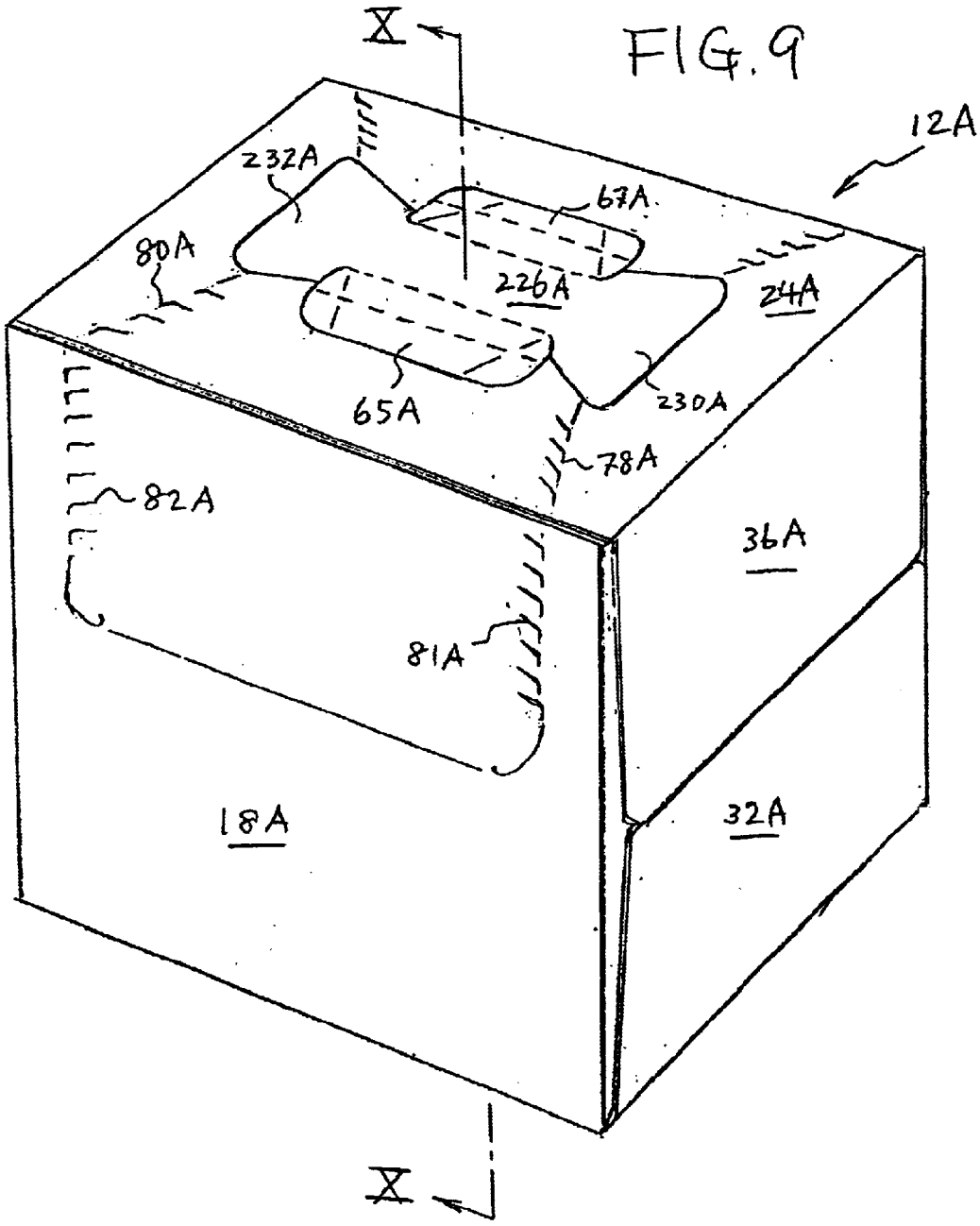
FIG. 9 is a perspective view of a completed carton erected from the blank of FIG. 8.
Figure 10:
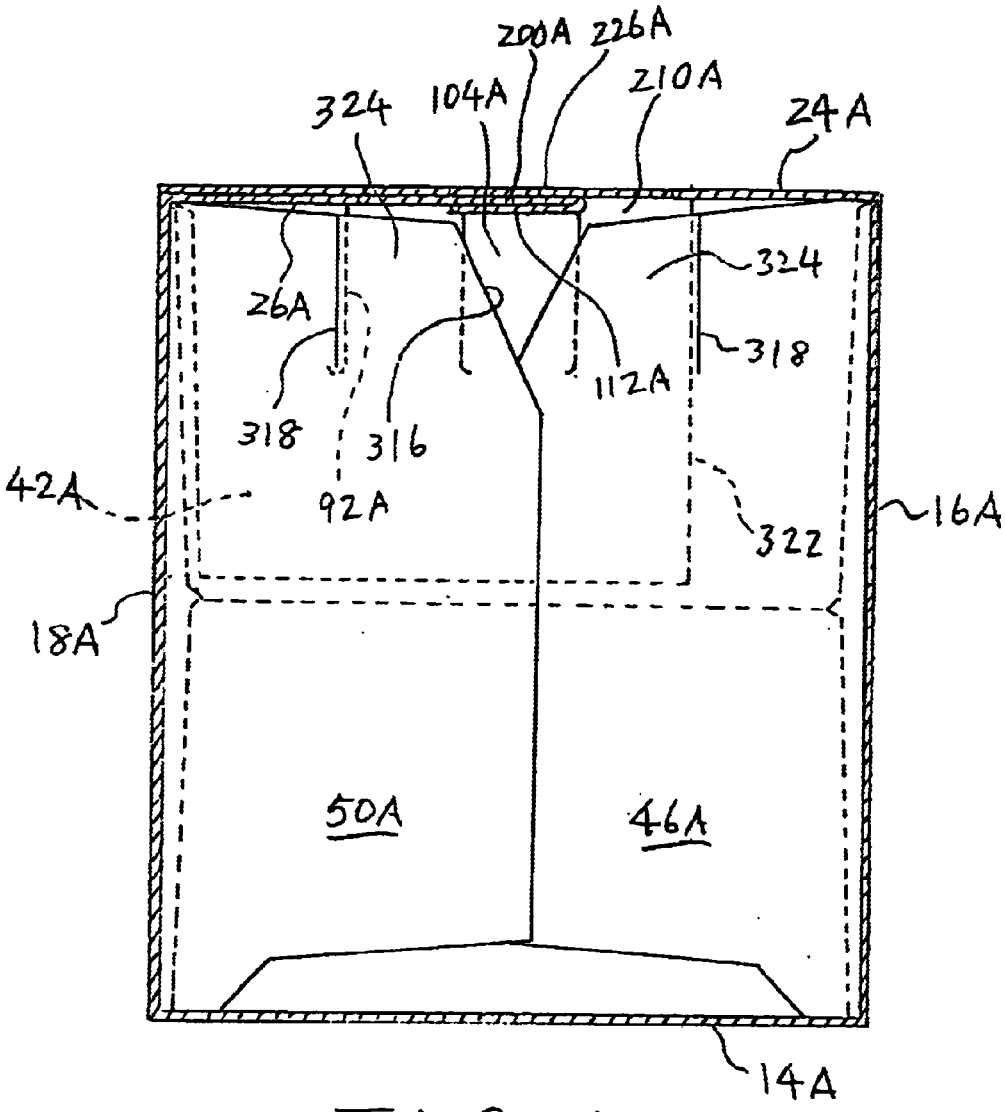
FIG. 10 is a view taken along the line X—X in FIG. 9.

A second embodiment of the invention is shown in FIGS. 8 to 11, where like parts have been designated by the same reference numeral with the suffix "A" and only the differences are discussed in any greater detail. As best shown in FIG. 8, the carton blank 10A has rectangular side panels 16A and 18A each provided with a pair of large-sized side end flaps 44A, 46A, 48A and 50A. The side end flaps 44A and 46A are hingedly connected to the side panel 16A along fold lines 58A and 58A while the side end flaps 48A and 50A are hingedly connected to the side panel 18A along fold lines 58A and 58A. The size of these large side end flaps is such that upon erection of a carton, the mating pair of side end flaps (such as at 44A and 48A) at each end of the carton overlap each other and they as a whole extend entirely across the width of the carton. This condition is best shown in FIG. 10 wherein the side end flaps 46A and 50A are viewed from the inside of a carton 12A (shown in FIG. 9) that is erected from the blank 10A. Each side end flap is provided at the corner between its upper edge 310 and its free end edge 312 with a beveled edge 314. The beveled edges 314 of the mating side end flaps define a notch 316 (shown in FIG. 10) when the carton 12A is erected. The notch 316 serves to receive an end bottle of the center row of the packaged bottle group when the carton 12A is lifted by the strap handle, which is described later in more detail.

Each side end flap is further provided with a severance line 318 (e.g., a slit, a tear line or the like) emanating from the upper edge 310 of that side end flap and extending toward the lower edge 320 of the same side end flap. The severance lines 318 are disposed and located such that when the carton 12A is erected, the severance line 318 of each side end flap is generally registered with the adjacent side edge of the adjacent forked end portion of the strap handle 200A. In FIG. 10, for example, the severance line 318 of the side end flap 46A is generally registered with, or slightly offset outwardly from, the side edge 322 of the forked end portion 210A. In like manner, the severance line 318 of the side end flap 50A is generally registered with, or slightly offset outwardly from, the other side edge (defined by the tear line 92A) of the forked end portion 210A. The length of each severance line 318 is generally equal to, or greater than, that of the handle-defining tear line in the adjacent inner upper end flap. In FIG. 10, for example, the severance line 318 of each of the side end flaps 46A and 50A is equal to, or greater in length than the tear line 92A in the inner upper end flap 42A.

Further, each side end flap is provided with a yielding flap 324 that is defined by the respective severance line 318, the respective upper edge 310 and the adjacent beveled edge 314. When the carton 12A is completed, the yielding flaps 324 form respective portions of the side end flaps 44A, 46A, 48A and 50A that are movable inwardly of the carton along with the end portions of the strap handle 200A.

The construction of the carton 12A is carried out in virtually the same way as that of the carton 12 of the preceding embodiment except for the steps of closing the opposite ends of the carton 12A. After filled bottles are loaded through the open ends of the tubular carton, the end flaps are folded inwardly in the sequence of the side end flaps, the lower end flaps, and the composite upper end flaps. During the above end-closing steps, glue is applied to either the outside surface of the yielding flaps 324 or the inside surface of the forked end portions 208A and 210A of the strap handle 200A. An example of such glue areas is shown by the stippling in FIG. 8 wherein the glue areas extends from the forked end portions 208A and 210A into the adjacent inner top end flaps 40A and 42. This glue application causes the stippled areas on the forked end portion 208A to become adhered to the outside surface of the yielding flaps 324 of the side end flaps 44A and 48A. In like manner, the stippled areas on the forked end portion 210A become adhered to the outside surface of the yielding flaps 324 of the side end flaps 46A and 50A. The completed carton 12A is shown in FIG. 9 wherein the upper and lower end flaps at each end of the carton 12A is secured in overlapping glued contact with the outside surfaces of the associated side end flaps.

Figure 11:
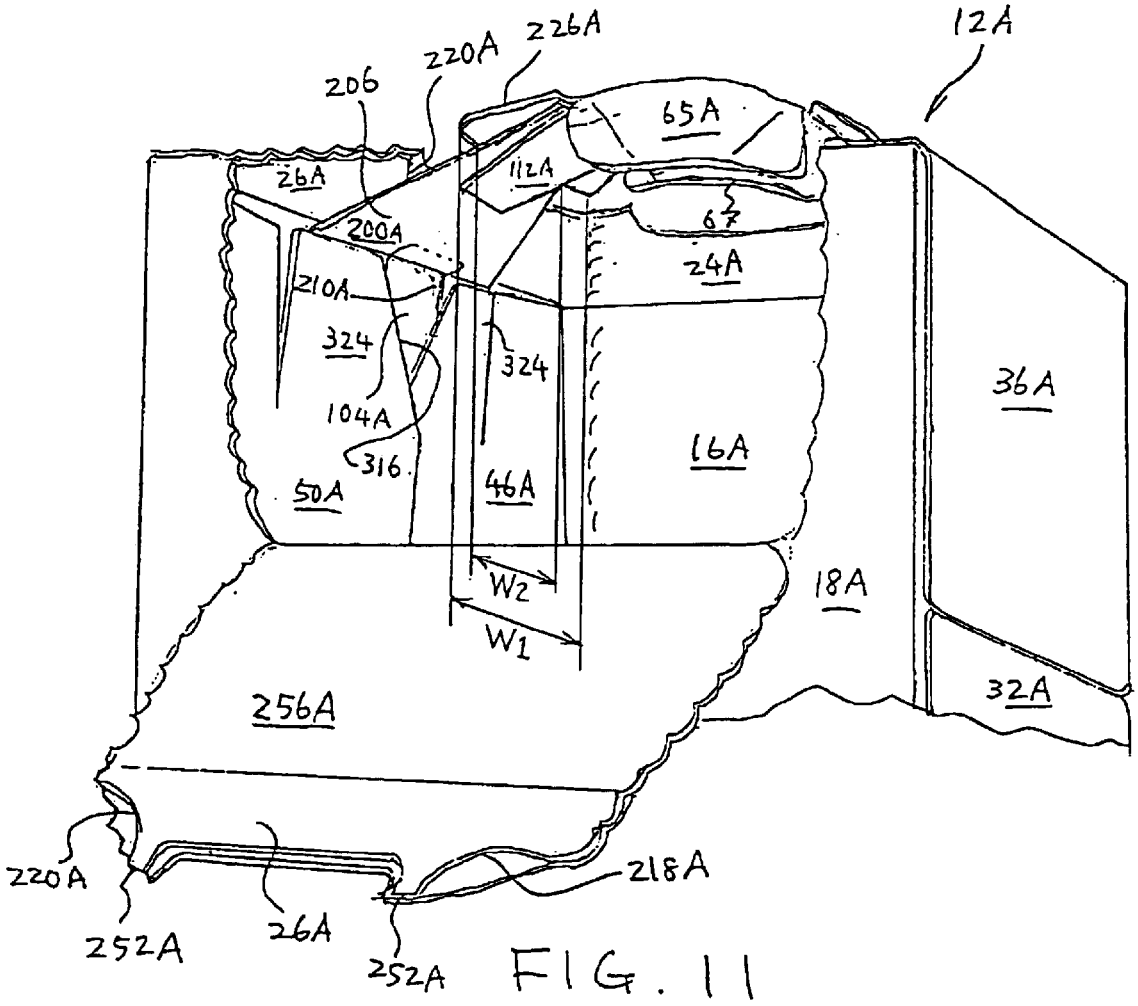
FIG. 11 is a fragmentary perspective view of the carton of FIG. 9, in which the tear flap is broke open to show the inside of the carton.

In the same way as described in the first embodiment, lifting the carton 12A by the strap handle 200A causes the handle 200A to be moved from its stowed position in FIG. 9 into the use position in FIG. 11. During this movement, the forked end portions 208A and 210A of the strap handle 200A are pulled toward each other so that a slack is available for the handle 200A to take the use position. The inward movement of the end portions 208A and 210A is facilitated by the yielding flaps 324 and 324 that are easily displaced inwardly of the carton along with the inward movement of the end portions 208A and 210A. This is best shown in FIG. 11 wherein the yielding flaps 324 are flexed out of the plane of the side end flaps 46A and 50A and thereby allowing the end portion 210A of the strap handle 200A to move inwardly of the carton 12A. The notches 316 defined by the respective beveled edges 314 functions to receive the end bottles of the center row of the packaged bottle group to allow the end portions 208A and 210A to move toward each other. The yielding tabs 96A and 104A remain flat with the respective upper end flaps 40A and 42A to define openings that cooperate with the notches 316 to receive the end bottles.

During the inward movement of the end portions 208A and 210A, part of the end portions 208A and 210A and/or the adjacent portions of the inner upper end flaps 40A and 42A may be forcibly peeled from the associated upper end flaps 36A and 38A if they have been glued, either purposely or inadvertently, to the upper end flaps 36A and 38A. Upon such peeling, some constituent pulp or fiber of end portions 208A and 210A could be taken away to the extent that the strap handle 200A is physically damaged or at least the structural strength of the handle 200A is somewhat affected. In the present invention, however, the yielding flaps 324 reinforce the end portions 208A and 210A and provide a precautionary measure against undesired damage of the strap handle 200A around the opposite end portions 208A and 210A.

Although it is not apparent from FIG. 11, relief notches 218A and 220A also function such that when the strap handle 200A is in the use position, the respective oblique side edges of the wider portions 204A and 206A are received in the relief notches 218A and 220A and thereby abutting and scraping of the oblique side edge of each wider portion against the complementary edge of the opening 252A in the inner top panel 26A is prevented.

Figure 12:
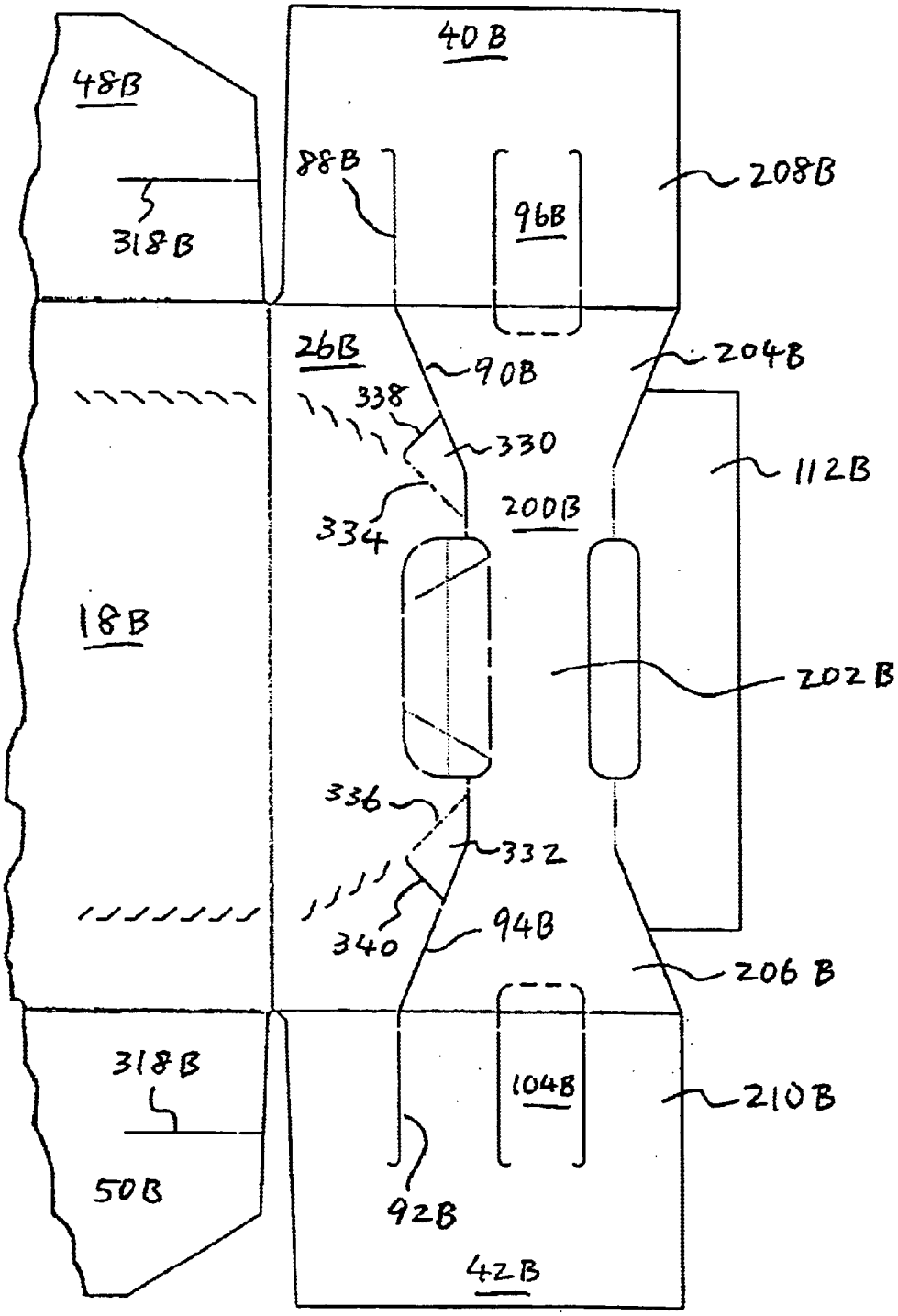
FIG. 12 is a fragmentary plan view of another carton blank, showing a first variation of the relief notches shown in FIG. 8.
Figure 13:
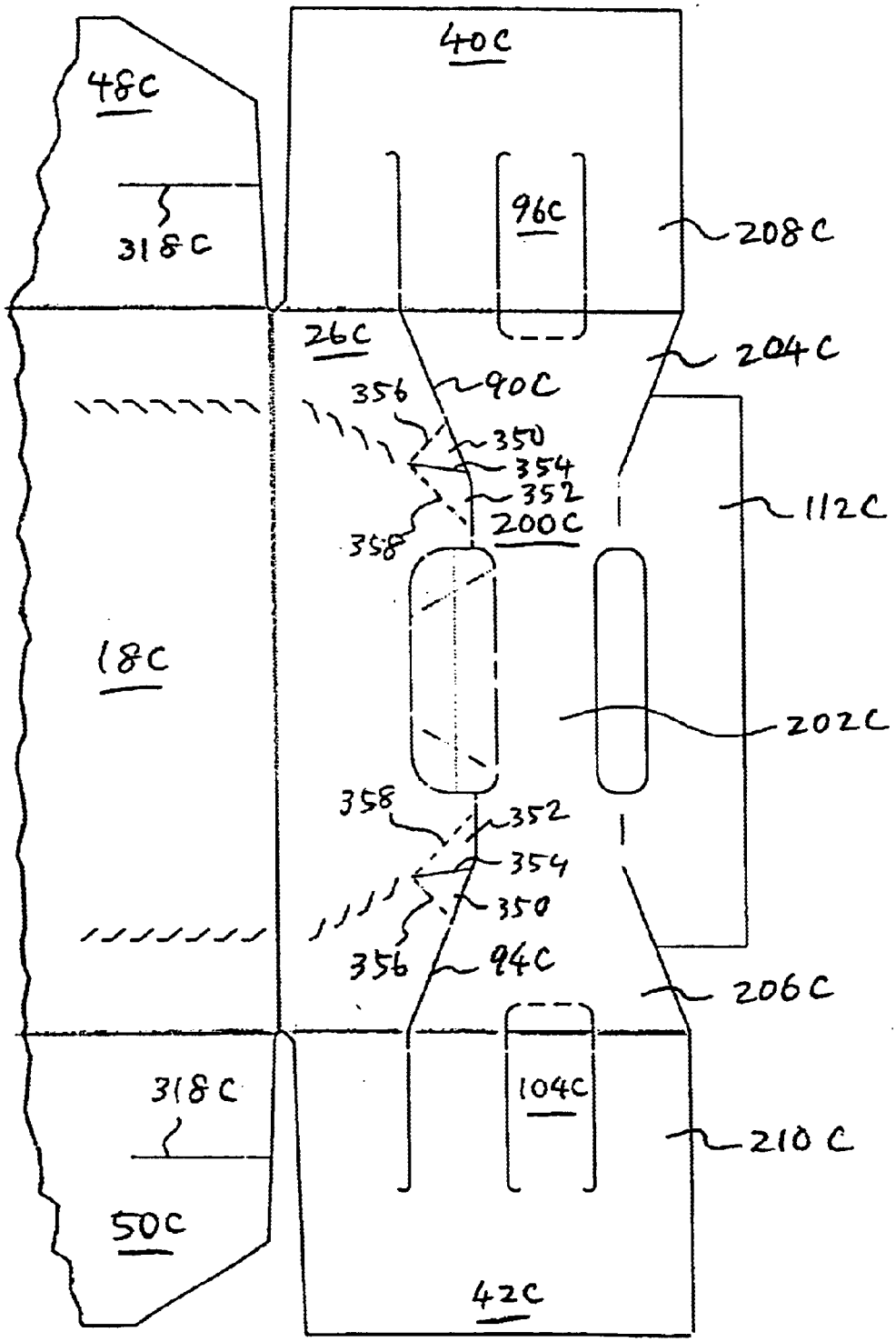
FIG. 13 is a fragmentary plan view of a still another carton blank, showing a second variation of the relief notches shown in FIG. 8.
Figure 14:
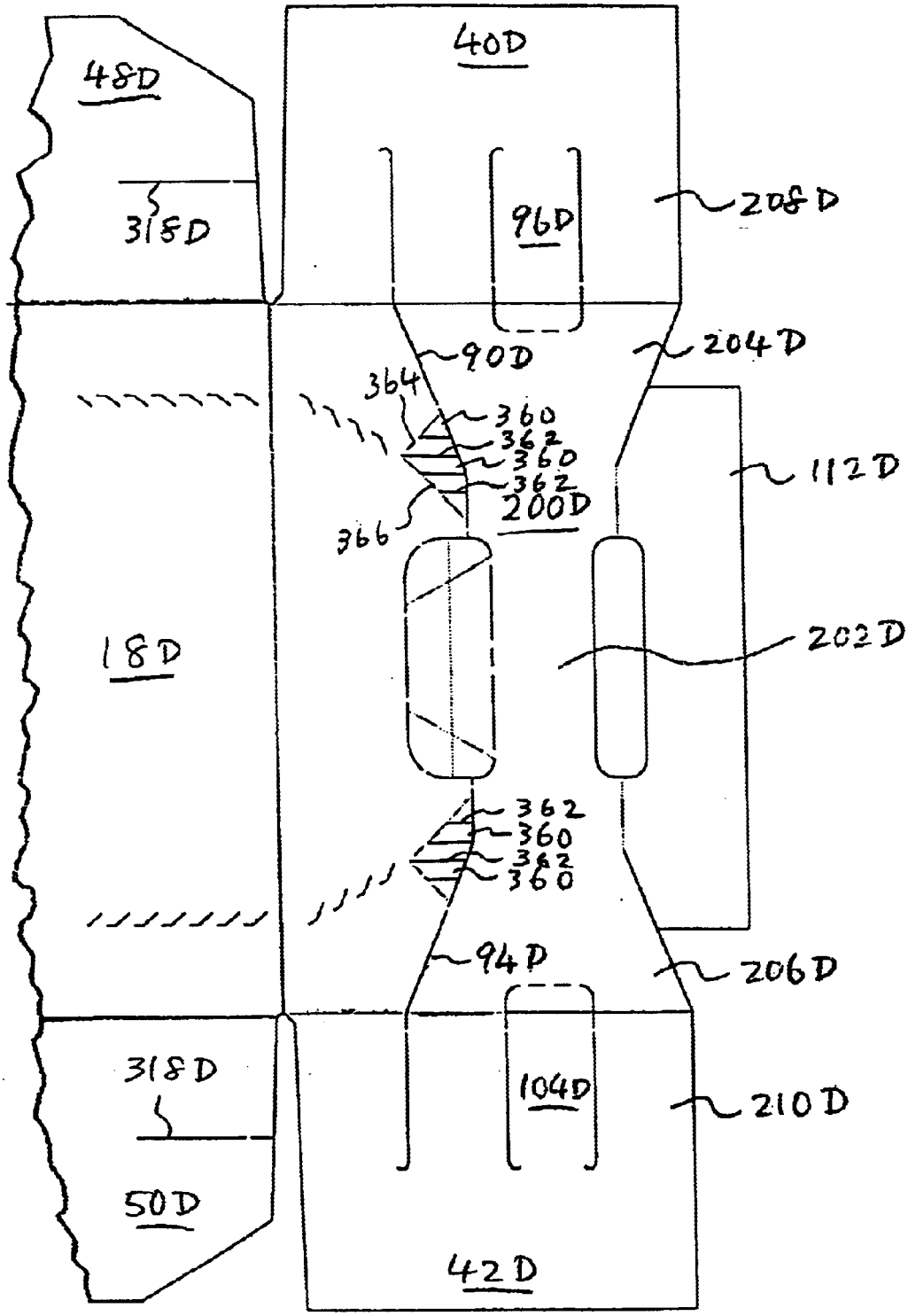
FIG. 14 is a fragmentary plan view of a further carton blank, showing a third variation of the relief notches shown in FIG. 8.

FIGS. 12–14 illustrate variations or alternative embodiments of the relief notches 218A and 220A in FIG. 8. In FIG. 12, parts corresponding to those in FIG. 8 have been designated by the same reference numeral with the suffix "B". In like manner, parts in FIG. 13 corresponding to those in FIG. 8 have been denoted by the same reference numeral with suffix "C" while parts in FIG. 14 corresponding to those in FIG. 8 have been denoted by the same reference numeral with suffix "D".

FIG. 12 shows the first variation wherein the relief notches are defined by hinged tabs 330 and 332, respectively. The hinged tab 330 is cut from the inner top panel 26B by means of a slit 338 and hingedly connected to the panel 26B along a fold line 334. The hinged tab 332 is also cut from the inner top panel 26B by a slit 340 and hingedly connected to the panel 26B along a fold line 336. When the strap handle 200B is pulled upward to lift a resultant carton, the respective parts of the wider portions 204B and 206B along tear lines 90B and 94B slide into the slits 338 and 340 while thrusting the tabs 330 and 332 downwardly. By this means, the slits 338 and 340 and/or the notches defined by the tabs 330 and 332 provide a similar effect to that of the relief notches in FIGS. 1 and 8.

In FIG. 13 where the second variation is shown, each relief notch is defined by a pair of hinged tabs 350 and 352. The hinged tabs 350 and 352 are cut from the inner top panel 26C by means of a slit 354 and hingedly connected to the panel 26C along convergent fold lines 356 and 358. The slit 354 emanates from the converging point of the fold lines 356 and 358 and extends to the adjacent tear line 90C or 94C. When the strap handle 200C is pulled upward, the respective parts of the wider portions 204C and 206C along tear lines 90C and 94C slide into the slits 354 and 354 while thrusting the tabs 350 upwardly and the tabs 352 downwardly. By this means, the slits 354 and/or the notches defined by the tabs 350 and 352 provide a similar effect to that of the relief notches in FIGS. 1 and 8.

Referring to the third variation in FIG. 14, each relief notch is defined by a plurality of hinged tabs 360. The hinged tabs 360 are cut from the inner top panel 26D by means of a plurality of slits 362 and hingedly connected to the panel 26D along convergent fold lines 364 and 366. The slits 362 emanate from the fold lines 364 and 366 and extend to the adjacent tear line 90D or 94D. When the strap handle 200D is pulled upward, the respective parts of the wider portions 204D and 206D along tear lines 90D and 94D slide into one of the slits 362 while thrusting one or more of the tabs 360 upwardly and the other tabs 360 downwardly. By this means, the slits 362 and/or the notches defined by the tabs 360 provide a similar effect to that of the relief notches in FIGS. 1 and 8

Figure 15:
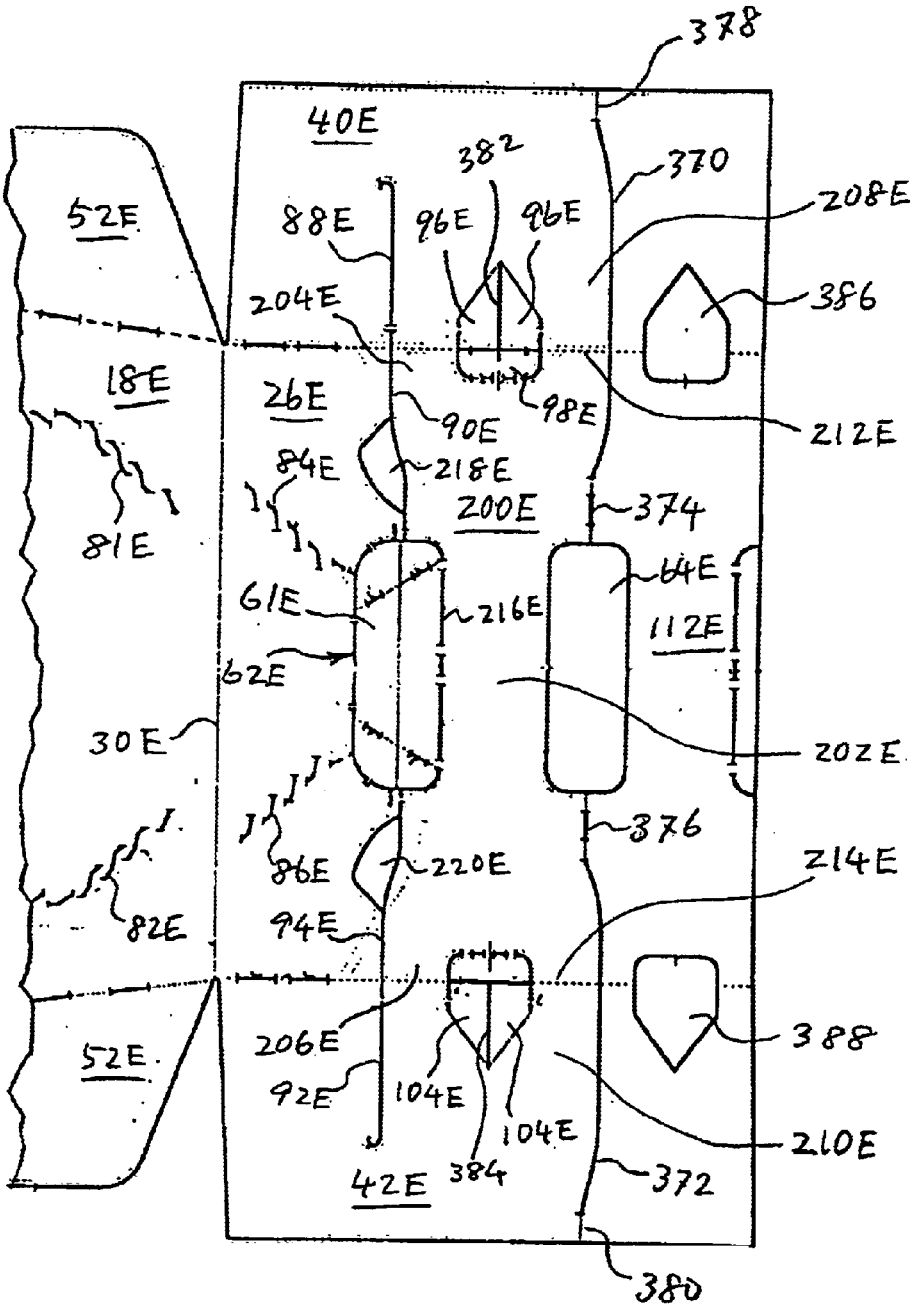
FIG. 15 is a fragmentary plan view of a further carton blank, showing a variation of the strap handle shown in FIG. 1.

FIG. 15 illustrates a variation or alternative embodiment of the strap handle 200 in FIG. 1. In FIG. 15, parts corresponding to those in FIG. 1 have been designated by the same reference numeral with the suffix "E". The inner top panel 26E and the upper end flaps 40E and 42E incorporate a series of continuous tear lines 88E, 90E, 92E and 94E which in cooperation with the finger receiving aperture 62E define one of the opposed longitudinal edges of the strap handle 200E. The other longitudinal edge of the strap handle 200E is defined by a pair of curved cut lines 370 and 372 and four spaced fold lines 374, 376, 378 and 380 that are aligned with one another. The strap handle 200E is flanked entirely along the other longitudinal edge by a handle reinforcing strip 112E. The reinforcing strip 112E is foldably joined to the medial grip portion 202E of the strap handle 200E along the fold lines 374 and 376 and to the upper end flaps 40E and 42E along the fold lines 378 and 380 respectively. The fold lines 374, 376, 378 and 380 are inset from those sections of the cut lines 370 and 372 defining the forked end portions 208E and 210E of the strap handle 200E. Stated differently, the fold lines 374, 376, 378 and 380 are offset from the sections of the cut lines 370 and 372 such that they are located closer the fold line 30E than the sections. These inset fold lines contribute to reduction or minimization of the sheet material (e.g., paperboard) required for the carton. The wider portions 204E and 206E of the strap handle 200E each has a pair of curved side edges defined by the respective ones of the tear lines 90E and 92E and cut lines 370 and 372.

A pair of yieldable tabs 96E and 96E are struck from, and hingedly connected to, the forked end portion 208E of the strap handle 200E. The adjacent ends of the yieldable tabs 96E and 96E are defined by a cut 382; however, they may be initially interconnected by severable means such as a half cut. In like manner, a pair of yieldable tab 104E and 104E are struck from, and hingedly connected to, the forked end portion 210E of the strap handle 200E. The adjacent ends of the tabs 104E and 104E are defined by a cut 384 or a half cut. Bottle top-receiving windows 386 and 388 are formed in the reinforcing strip 112E so that they are positioned astride the respective extensions of the fold lines 212E and 214E. Upon formation of the top wall, the reinforcing strip 112E is folded along the fold lines 374, 376, 378 and 380 into face-contacting relationship with the underside of the strap handle 200E, and then the outer top panel (see FIG. 1, at 24) is folded over and is adhesively secured to the inner top panel 26E. The fold lines 374, 376, 378 and 380 are positioned such that the windows 386 and 388 are brought into registry respectively with the pairs of yieldable tabs 96E and 104E when the reinforcing strip 112E is folded under the handle strap 200E.

Whilst the above embodiments describes the strap handle formed from the inner top panel only, the handle may be formed from the outer top panel or from both the inner and outer top panels. In the arrangement where the outer top panel provides the handle, the relief notch should be formed at least in the outer top panel alongside the wider portions of the strap handle. The wider portions in the present invention are not limited to those defined by the straight tear lines or cut lines such as shown in the above embodiments but also include those defined by curved lines such that the width of each wider portion is increased toward the end edges of the associated carton wall from which the handle is formed.

It should be also appreciated that the precise closure of the ends of the carton is open to adaptation and could in fact be partially open. In addition, a single end closure flap could be provided at each end of the carton depending on design choice. Furthermore, the pack may incorporate part angled walls so as to follow better the contours of certain articles, such as bottles, being packaged.

It should be further appreciated that the strap handles useful in the present invention are not limited to those having forked end portions but include those having regular non-bifurcated opposite end portions.

It should be still further appreciated that the yielding flaps useful in the present invention are not limited to those glued to the associated handle end portions but include those separate from the associated handle end portions. Such unglued yielding flaps do not reinforce the handle ends but they still facilitate inward movement of the handle end portion. Therefore, unglued yielding flaps may also be useful in some situation where large-sized side end flaps are required in order for the cartons to run on a specific packaging machine.

It should be still further appreciated that the yielding flaps useful in the present invention are not limited to those formed from the large-sized side end flaps that extend entirely across the width of a carton. Any side end flap that overlaps a handle end may provide a yielding flap to facilitate inward movement of the associated strap handle.

It should be still further appreciated that as used herein, directional references such as "top", "base", "end", "side", "upper" and "lower" do not limit the respective panels to such orientation, but merely serve to distinguish these panels from one another. The orientation of the carton could be altered depending on, for example, the articles to be carried in the carton. Simple modifications could result in the handle being located on the side of the carton when the carton is in its standard stowed position. One of the side panels 16 and 18 would then effectively be the top panel of the carton.

It should be still further appreciated that any reference to hinged connection should not be construed as necessarily referring to a single fold line only: indeed it is envisaged that hinged connection can be formed from one or more of one of the following, a score line, a frangible line or a fold line, without departing from the scope of invention.

What is claimed is:

1. A carton comprising an inner top panel, a pair of opposed end panels hingedly connected to the inner top panel, and an integral strap handle extending between the end panels across the inner top panel, said strap handle including a medial grip portion, a pair of wider portions joined to opposite ends of said medial grip portion and opposed end portions connected to said wider portions respectively, each of said wider portions having a pair of oblique side edges diverging from said medial grip portion toward an adjacent one of said end portions, said opposed end portions being formed from said end panels, said medial and wider portions being formed from said inner top panel, said strap handle being connected at said opposed end portions to said opposed end panels such that said strap handle is movable from a stowed position where said medial and wider portions lie in a plane of said inner top panel to a use position where said medial portion is arched upwardly from said plane of said inner top panel, said strap handle defining in said inner top panel an internal opening extending across said inner top panel, the carton further comprising an outer top panel secured to an outside surface of said inner top panel to form a composite top wall, said outer top panel having a handle access opening defined within said outer top panel, said handle access opening being vertically aligned in part with said medial grip portion and in part with said wider portions, said handle access opening having opposite end edges extending respectively across said wider portions, the width of said access opening alone said opposite end edges being greater than the width of said wider portions along said opposite end edges so that a part of said each wider portion is extended through said handle access opening when said strap handle is moved to said use position.

2. The carton according to claim 1 wherein each of said opposite end edges is disposed transversely of said oblique side edges of a respective one of said wider portions.

3. The carton according to claim 2 wherein said relief notch is defined by at least one hinged tab formed from and hingedly connected to said inner top panel.

4. The carton according to claim 3 wherein said relief notch is defined by a hinged tab that is defined by a slit in said inner top panel and by a fold line hingedly connecting said hinged tab to said inner top panel.

5. The carton according to claim 3 wherein said relief notch is defined by a plurality of hinged tabs.

6. The carton according to claim 5 wherein said hinged tabs for said relief notch are cut from said inner top panel one or more slits such that when said strap handle is moved to said use position, said part of said each wider portion moves into one of said one or more slits to thrust one or more of said hinged tabs upward and the other tabs downward.

7. The carton according to claim 6 wherein said hinged tabs for said relief notch are connected to said inner top panel along a fold line, said one or more slits for said relief notch emanate from said fold line and extend to said complementary side edge of said internal opening.

8. The carton according to claim 1 wherein said inner top panel has a relief notch at a location directly adjoining each of said wider portions along a complementary side edge of said internal opening so that a part of said each wider portion is extended through said relief notch and said handle access opening when said strap handle is moved to said use position.

9. A carton comprising top and base panels interconnected by opposed side panels to form a tubular structure, opposed end closure structures for at least partially closing the opposite ends of said tubular structure, and an integral strap handle extending between said end closure structures across the top panel, each of said end closure structures including a pair of side end flags hingedly connected to said side panels and a top end flap hingedly connected to said top panel, said top end flap of said each end closure structure being disposed on outside surfaces of adjacent side end flaps, said strap handle including a medial grip portion formed from the top panel and opposed end portions formed respectively from said top end flaps, said strap handle being connected at said opposed end portions to said end closure structures such that said strap handle is movable from a stowed position where said opposed end portions lie in respective planes of said top end flaps to a use position where said opposed end portions are disposed inwardly of said respective planes, at least one of said side end flaps of said each end closure structure comprising a yielding flap, said yielding flap being disposed along an adjacent end portion of said strap handle such that said yielding flap is inwardly displaced in response to inward movement of said handle end portions upon movement of said strap handle to said use position, and wherein each of said yielding flaps is secured to a respective one of said end portions of said strap handle to reinforce said strap handle.

10. A carton comprising top and base panels interconnected by opposed side panels to form a tubular structure, opposed end closure structures for at least partially closing the opposite ends of said tubular structure, and an integral strap handle extending between said end closure structures across the top panel, each of said end closure structures including a pair of side end flaps hingedly connected to said side panels and a top end flag hingedly connected to said top panel, said top end flap of said each end closure structure being disposed on outside surfaces of adjacent side end flaps, said strap handle including a medial grip portion formed from the top panel and opposed end portions formed respectively from said top end flaps, said strap handle being connected at said opposed end portions to said end closure structures such that said strap handle is movable from a stowed position where said opposed end portions lie in respective planes of said top end flaps to a use position where said opposed end portions are disposed inwardly of said respective planes, at least one of said side end flaps of said each end closure structure comprising a yielding flap, said yielding flap being disposed alone an adjacent end portion of said strap handle such that said yielding flag is inwardly displaced in response to inward movement of said handle end portions upon movement of said strap handle to said use position, and wherein each of said yielding flaps is defined by a severance line in a respective one of said side end flaps and by a free end edge of said respective side end flap, said severance line extending downwardly from an upper edge of said respective side end flap.

11. The carton according to claim 10 wherein said severance line of said respective side end flap is disposed and located such that said severance line of said respective side end flap is generally registered with an adjacent side edge of said adjacent end portion of said strap handle.

12. A carton comprising a pair of inner and outer top panels secured together in an overlapping relationship to form a composite top wall, a base wall, a pair of side walls interconnecting said top and base walls, a pair of opposed inner end flaps hingedly connected to opposed end edges of said inner top panel and extending toward said base wall, a pair of opposed outer end flaps hingedly connected to opposed end edges of said outer top panel and disposed respectively on outside surfaces of said inner end flaps, and an integral strap handle disposed internally of the carton and extending between said inner end flaps across said inner top panel, said strap handle including a medial grip portion, a pair of wider portions joined to opposite ends of said medial grip portion and a pair of opposed forked-end portions connected to said wider portions respectively, said opposed end portions being formed from said inner end flaps, said medial and wider portions being formed from said inner top panel, said outer top panel having a handle access opening formed within said outer top panel such that the periphery of said handle access opening is provided entirely by said outer top panel, said handle access opening being vertically aligned with said medial grip portion of said strap handle, said forked-end portions of said strap handle being joined to said inner end flaps respectively and being free of restraint of said outer end flaps.

13. The carton according to claim 12 wherein a handle-reinforcing strip is disposed in face-contacting relationship with said strap handle, said reinforcing strip being disposed at least along said medial grip portion of said strap handle and hingedly connected to said strap handle.

14. The carton according to claim 13 wherein said outer top panel includes a cover strip defined within said outer top panel, said cover strip being severably connected to said outer top panel such that said handle access opening is defined in said top panel upon severance of said cover strip to allow access to said strap handle through said handle access opening.

15. The carton according to claim 14 wherein said cover strip is secured to said medial grip portion of said strap handle.

16. The carton according to claim 15 wherein a pair of hand flaps are hingedly connected to said cover strip such that said hand flaps are folded inwardly of the carton when said cover strip is grasped together with said medial grip portion to lift the carton by said strap handle.

17. The carton according to claim 16 wherein an yieldable tab is formed from each forked end portion of said strap handle and is foldably joined to a respective inner end flap.

18. The carton according to claim 17 wherein a short stub tab is formed from each wider portion of said strap handle and is hingedly connected to said each wider portion.

19. The carton according to claim 18 wherein adjacent ends of said yieldable and stub tabs are initially interconnected by severable line that is aligned with a fold line between an adjacent inner end flap and said inner top panel.

20. A carton comprising top and base panels interconnected by opposed side panels, opposed end closure structures for at least partially closing opposite ends of the carton, and a strap handle extending between said end closure structures across the top panel, each of said end closure structures including a pair of side end flaps hingedly connected to said side panels and a top end flap hingedly connected to said top panel, said side end flaps of said each end closure structure being disposed inwardly of a respective top end flap, said strap handle including a medial grip portion disposed under said top panel and opposed end portions disposed adjacent said end closure structures respectively, each end portion of said strap handle being disposed between an adjacent top end flap and adjacent side end flaps, said strap handle being connected at said end portions respectively to said end closure structures such that said strap handle is movable from a stowed position where said opposed end portions are disposed respectively on inside surfaces of said top end flaps to a use position where said opposed end portions are at least partially spaced inwardly from said inside surfaces of said top end flaps, at least one of said side end flaps of said each end closure structure comprising a yielding flap, said yielding flap being disposed along an adjacent end portion of said strap handle such that said yielding flap is inwardly displaced in response to inward movement of said handle end portions upon movement of said strap handle to said use position, and wherein each of said yielding flaps is defined by a severance line in a respective one of said side end flaps and by a free end edge of said respective side end flap, said severance line extending downwardly from an upper edge of said respective side end flap.

21. The carton according to claim 20 wherein said severance line of said respective side end flap is disposed and located such that said severance line of said respective side end flap is generally registered with an adjacent side edge of said adjacent end portion of said strap handle.

22. The carton according to claim 20 wherein said top panel includes a cover strip defined within said top panel, said cover strip being severably connected to said top panel such that a handle access opening is defined in said top panel upon severance of said cover strip to allow access to said strap handle through said handle access opening.

23. A carton comprising top and base panels interconnected by opposed side panels to form a tubular structure, opposed end closure structures for at least partially closing the opposite ends of said tubular structure, and an integral strap handle extending between said end closure structures across the ton panel, each of said end closure structures including a pair of side end flaps hingedly connected to said side panels and a top end flap hingedly connected to said top panel, said top end flap of said each end closure structure being disposed on outside surfaces of adjacent side end flaps, said strap handle including a medial grip portion formed from the ton panel and opposed end portions formed respectively from said ton end flaps, said strap handle being connected at said opposed end portions to said end closure structures such that said strap handle is movable from a stowed position where said opposed end portions lie in respective planes of said top end flaps to a use position where said opposed end portions are disposed inwardly of said respective planes, at least one of said side end flaps of said each end closure structure comprising a yielding flap, said yielding flap is inwardly displaced in response to inward of said strap handle such that said yielding flan is inwardly displaced in response to inward movement of said handle end portions upon movement of said strap handle to said use position, wherein the size of said side end flaps is such that said side end flaps of said each end closure structure overlap each other and as a whole extend entirely across the width of said carton, wherein each of said side end flaps of said each end closure structure is provided at an upper end corner thereof with a beveled edge, and the beveled edges of said side end flaps of said each end closure structure define a notch for receiving an article packaged in said carton.

* * * * *